US011380235B2

(12) United States Patent
Huang et al.

(10) Patent No.: US 11,380,235 B2
(45) Date of Patent: Jul. 5, 2022

(54) PIXEL ARRAY SUBSTRATE WITH NARROW PERIPHERAL AREA AND NARROW BEZEL DESIGN OF DISPLAY PANEL

(71) Applicant: Au Optronics Corporation, Hsinchu (TW)

(72) Inventors: Shu-Hao Huang, Hsinchu (TW); Sung-Yu Su, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 233 days.

(21) Appl. No.: 16/871,066

(22) Filed: May 11, 2020

(65) Prior Publication Data

US 2021/0104192 A1 Apr. 8, 2021

(30) Foreign Application Priority Data

Oct. 2, 2019 (TW) ..... 108135746

(51) Int. Cl.
*G09G 3/20* (2006.01)

(52) U.S. Cl.
CPC ..... *G09G 3/20* (2013.01); *G09G 2300/0439* (2013.01); *G09G 2310/0297* (2013.01)

(58) Field of Classification Search
CPC ..... G09G 3/20; G09G 2300/0408; G09G 2310/0297; G09G 2310/0281; G09G 2300/0439; G09G 2300/0426; G09G 2320/0223
See application file for complete search history.

(56) References Cited

U.S. PATENT DOCUMENTS

2016/0232837 A1* 8/2016 Lee ..... G09G 3/3275
2018/0197456 A1* 7/2018 Xing ..... G09G 3/2092

FOREIGN PATENT DOCUMENTS

CN 104950496 3/2018
CN 108766338 11/2018
CN 107887420 4/2020

* cited by examiner

*Primary Examiner* — Kwang-Su Yang
(74) *Attorney, Agent, or Firm* — JCIPRNET

(57) ABSTRACT

A pixel array substrate including a substrate, a plurality of first signal lines, a plurality of second signal lines, a plurality of pixels, a first demultiplexer, a second demultiplexer, a first connecting line and a second connecting line is provided. The substrate has a display area. The first signal lines are arranged on the substrate and define a first row region and a second row region of the display area. The pixels are arranged into a first pixel row and a second pixel row which are respectively disposed in the first row region and the second row region. The first demultiplexer is disposed in the first row region and electrically connected to a part of the second signal lines. The second demultiplexer is disposed in the second row region and electrically connected to another part of the second signal lines. The first connecting line is electrically connected to the first demultiplexer. The second connecting line is electrically connected to the second demultiplexer. The electrical resistivity of the first connecting line and the second connecting line is greater than the electrically resistivity of the first signal lines and the second signal lines.

20 Claims, 6 Drawing Sheets

PIXEL ARRAY SUBSTRATE WITH NARROW PERIPHERAL AREA AND NARROW BEZEL DESIGN OF DISPLAY PANEL

CROSS-REFERENCE TO RELATED APPLICATION

This application claims the priority benefit of Taiwan application serial no. 108135746, filed on Oct. 2, 2019. The entirety of the above-mentioned patent application is hereby incorporated by reference herein and made a part of this specification.

BACKGROUND

Technical Field

The present application relates to a display technology, and particularly to a pixel array substrate.

Description of Related Art

Mobile devices such as smartphones and tablets equipped with retina displays have brought consumers an unprecedented visual experience, but have also led to the development of headset display technologies such as Virtual Reality (VR), Augmented Reality (AR) and Mixed Reality (MR). To make the display of these applications more realistic, an ultra-high resolution display panel is essential.

However, as the resolution of the display panel continues to increase, the number of driving signal lines also increases, and the number of peripheral traces connected to the driving signal lines results in a significant reduction in the layout space of the circuit in the peripheral area. Even though the use of demultiplexers reduces the number of peripheral traces, it still takes up part of the peripheral area, making the narrow bezel design of the display panel impossible to achieve.

SUMMARY

The present application provides a pixel array substrate with a narrower peripheral area and a better design margin for bonding pads.

The present application provides a pixel array substrate with a narrow peripheral area and a better design margin for connecting lines.

The pixel array substrate of the present application comprises a substrate, a plurality of first signal lines, a plurality of second signal lines, a plurality of pixels, a first demultiplexer, a second demultiplexer, a first connecting line, a second connecting line. The substrate has a display area. The first signal lines are arranged on the substrate and define a first row region and a second row region of the display area. The second signal lines are intersected with the first signal lines. The pixels are electrically connected to the corresponding first signal lines and the conesponding second signal lines respectively, wherein the pixels are arranged into a first pixel row and a second pixel row, and the first pixel row and the second pixel row are respectively disposed in the first row region and the second row region. The first demultiplexer is disposed in the first row region and electrically connected to a part of the second signal lines. The second demultiplexer is disposed in the second row region and electrically connected to another part of the second signal lines. The first connecting line is electrically connected to the first demultiplexer. And, the second connecting line is electrically connected to the second demultiplexer, wherein an electrical resistivity of the first connecting line and the second connecting line is greater than an electrical resistivity of the first signal lines and the second signal lines.

The pixel array substrate of the present application comprises a substrate, a plurality of first signal lines, a plurality of second signal lines, a plurality of pixels, a first demultiplexer, a second demultiplexer, a first connecting line and a second connecting line. The substrate has a display area. The first signal lines are arranged on the substrate and define a first row region and a second row region of the display area. The second signal lines are intersected with the first signal lines. The pixels are electrically connected to the corresponding first signal lines and the corresponding second signal lines respectively, wherein the pixels are arranged into a first pixel row and a second pixel row, and the first pixel row and the second pixel row are respectively disposed in the first row region and the second row region. The first demultiplexer is disposed in the first row region and electrically connected to a part of the second signal lines. The second demultiplexer is disposed in the second row region and electrically connected to another part of the second signal lines. The first connecting line and the second connecting line are electrically connected to the first demultiplexer and the second demultiplexer respectively, wherein an electrical resistivity of the first connecting line and the second connecting line is greater than an electrical resistivity of the first signal lines and the second signal lines. The first connecting line and the second connecting line respectively have at least one first part and at least one second part, wherein the first part has a first width in an extension direction perpendicular to the first signal lines, the second part has a second width in an extension direction perpendicular to the second signal lines, and the first width is not equal to the second width.

Based on the above, in the pixel array substrate of an embodiment of the present application, the peripheral area can be effectively reduced by the configuration relationship between the demultiplexers and the connecting lines in the display area, which helps to realize a narrow bezel design of the display panel. In addition, the design margin for circuits of the pixel array substrate can be increased because the electrical resistivity of the connecting lines is greater than the electrical resistivity of the signal lines. On the other hand, disposing the two demultiplexers in different regions of the pixel array substrate can increase the design margin for the demultiplexers and improve the operating electricity of the pixel array substrate.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
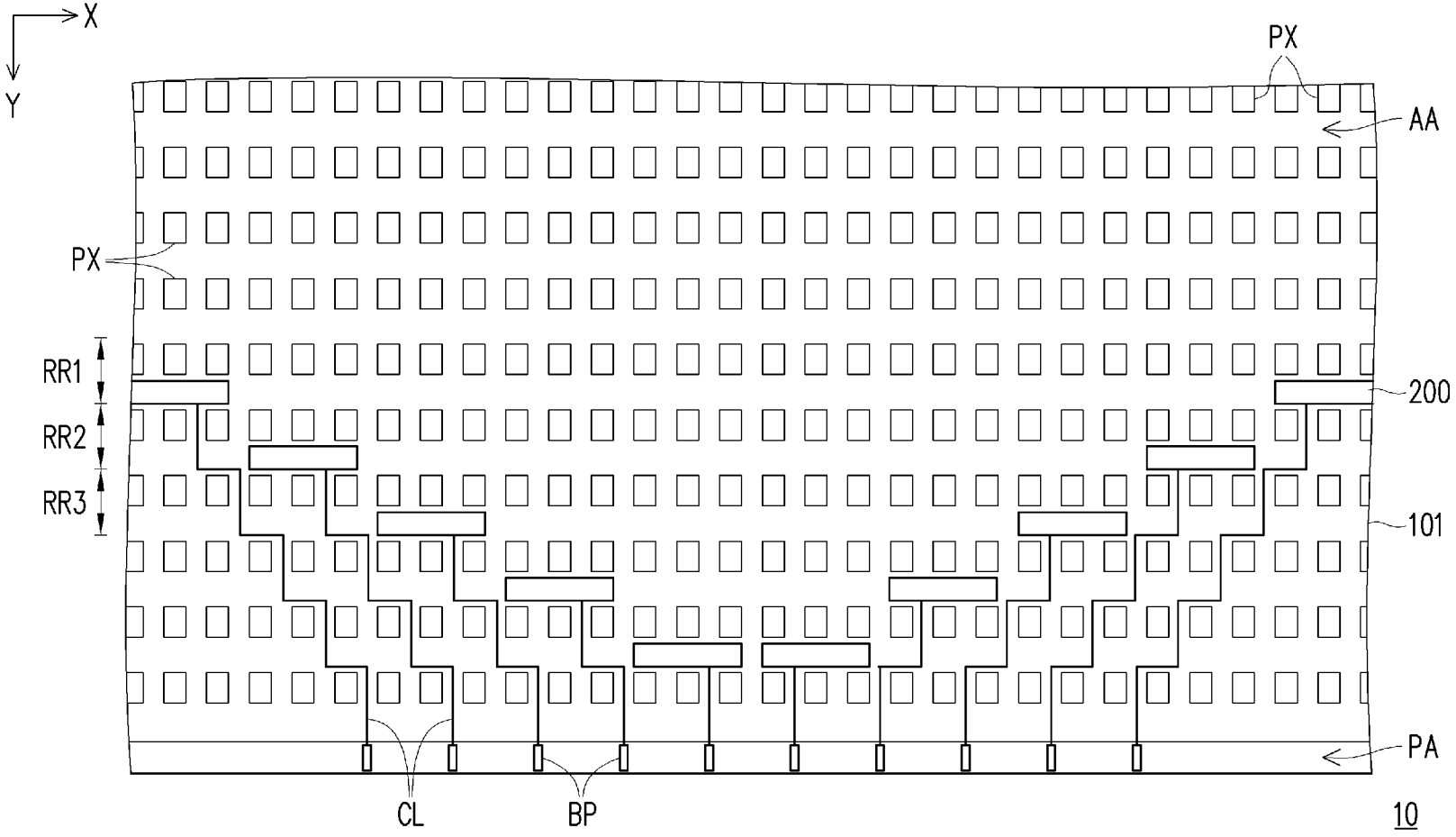
FIG. 1 is a schematic top view of a pixel array substrate according to a first embodiment of the present application.

The term "about," "approximately," "essentially" or "substantially" as used herein is inclusive of the stated value and means within an acceptable range of deviation for the particular value as determined by those of ordinary skill in the art, considering the measurement in question and the error associated with measurement of the particular quantity (i.e., the limitations of the measurement system). For example, "about" may mean within one or more standard deviations, or within, for example, ±30%, ±20%, ±15%, ±10%, ±5% of the stated value. Moreover, a relatively acceptable range of deviation or standard deviation may be chosen for the term "about," "approximately," "essentially" or "substantially" as used herein based on measuring properties, cutting properties or other properties, instead of applying one standard deviation across all the properties.

In the accompanying drawings, thicknesses of layers, films, panels, regions and so on are exaggerated for clarity. It should be understood when an element such as a layer, film, region or substrate is referred to as being "on" or "connected to" another element, it can be directly on or connected to the other element, or intervening elements may also be present. In contrast, when an element is referred to as being "directly on" or "directly connected to" another element, there are no intervening elements present. As used herein, the term "connected" may refer to physically connected and/or electrically connected. Therefore, the electrical connection may be referred to an intervening element exist between two elements.

In addition, relative terms such as "below" or "bottom" and "above" or "top" may be used herein to describe the relationship of one component to another, as illustrated. It should be understood that the relative terminology is intended to include different orientations of the device in addition to those shown in the figure. For example, if a device in the accompanying drawing is flipped, the component described as being on the "lower" side of the other component will be oriented on the "upper" side of the other component. Thus, the exemplary term "below" can include both "lower" and "upper" orientations, depending on the particular orientation of the attached map. Similarly, if a device in an accompanying diagram is flipped, the component described as being "under" the other component will be directed "upper" the other component. Thus, the exemplary terms "above" or "below" can include both upper and lower orientations.

Reference will now be made in detail to the present preferred embodiments of the disclosure, examples of which are illustrated in the accompanying drawings. Wherever possible, the same reference numerals are used in the drawings and the description to refer to the same or like parts.

Figure 2:
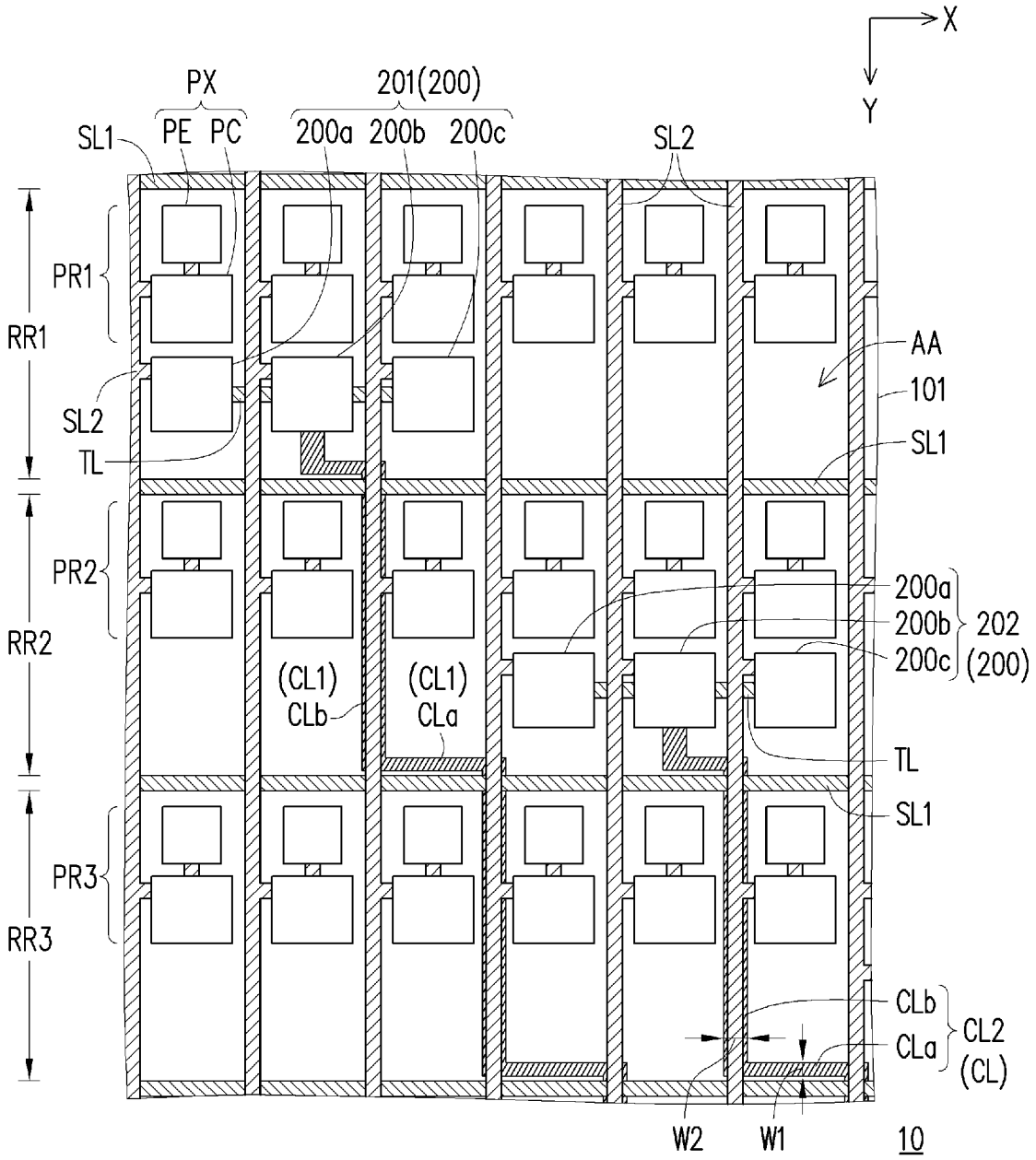
FIG. 2 is an enlarged schematic view of a partial area of the pixel array substrate of FIG. 1.
Figure 3:
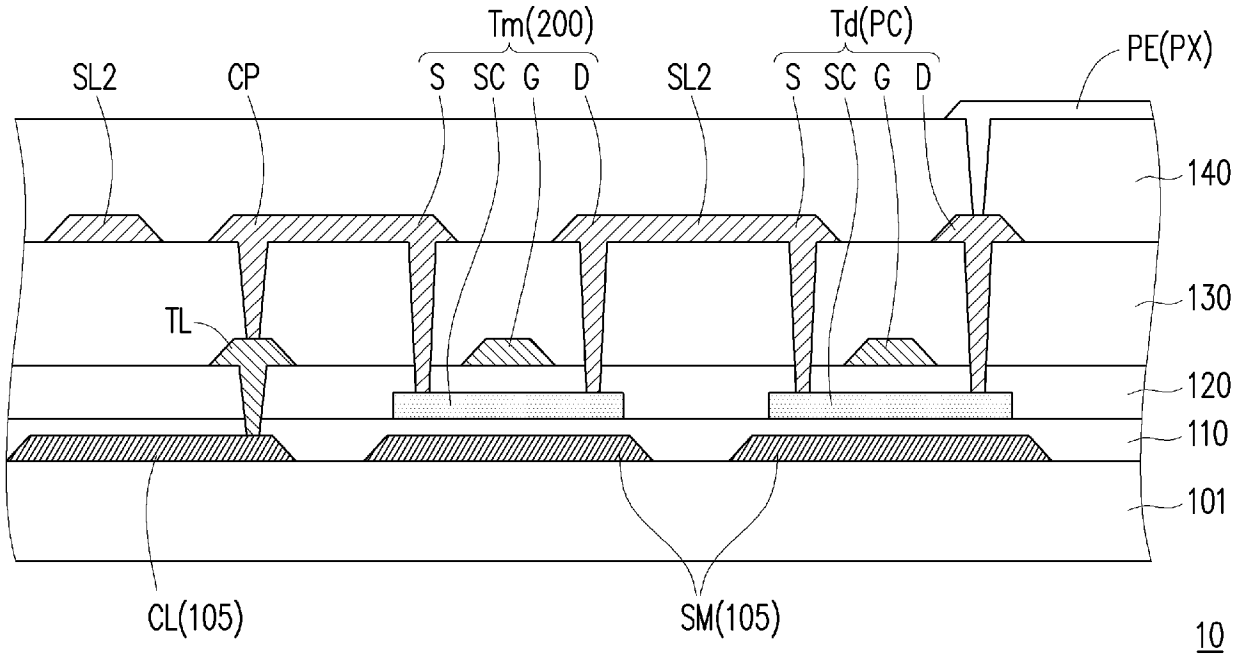
FIG. 3 is a partial cross-sectional view of the pixel array substrate of FIG. 2.

FIG. 1 is a schematic top view of a pixel array substrate according to the first embodiment of the present application. FIG. 2 is an enlarged schematic view of a partial area of the pixel array substrate of FIG. 1. FIG. 3 is a partial cross-sectional view of the pixel array substrate of FIG. 2. In particular, for the sake of clarity, FIG. 1 omits the first signal line SL1 and the second signal line SL2 of FIG. 2, and FIG. 2 omits the buffer layer 110, the gate insulating layer 120, the interlayer insulating layer 130 and the planarization layer 140 of FIG. 3.

Referring to FIG. 1 and FIG. 2, the pixel array substrate 10 includes a substrate 101, a plurality of first signal lines SL1, a plurality of second signal lines SL2 and a plurality of pixels PX. The substrate 101 has a display area AA and a peripheral area PA disposed on one side of the display area AA. The first signal lines SL1 are arranged on the substrate 101, and define a plurality of row regions of the display area AA, such as the row region RR1, the row region RR2, and the row region RR3. The second signal lines SL2 are arranged on the substrate 101 and intersected with the first signal lines SL1. The pixels PX can be arranged into multiple pixel rows, such as the pixel row PR1, the pixel row PR2 and the pixel row PR3, and are respectively arranged in the row regions of the display area AA. For example: the pixel row PR1, the pixel row PR2 and the pixel row PR3 are located in the row region RR1, the row region RR2 and the row region RR3 of the display area AA, respectively.

The pixels PX are electrically connected to the corresponding first signal lines SL1 and the corresponding second signal lines SL2. For example, one pixel PX may include a pixel circuit PC and a pixel electrode PE, where the pixel circuit PC may have an active device (e.g., the active device Td shown in FIG. 3), and the pixel electrode PE is electrically connected to the second signal line SL2 through penetrates the active device. In the present embodiment, the first signal line SL1 is, for example, a scan line, and the second signal line SL2 is, for example, a data line, while the present application is not limited thereto. In consideration of conductivity, the first signal lines SL1 and the second signal lines SL2 are generally made of metal material, but not limited in the present application. According to other embodiments, the first signal lines SL1 and the second signal lines SL2 can be made of other conductive materials, such as: alloys, metal nitrides, metal oxides, metal nitrogen oxides, or other suitable material, or a stacked layer of metal material and other conductive material.

In addition, the pixel array substrate 10 further includes the demultiplexer 201, the demultiplexer 202, the connecting lines CL1 and the connecting lines CL2 in the display area AA, and multiple bonding pads BP in the peripheral area PA. The demultiplexer 201 is located in the row region RR1 of the display area AA, and is electrically connected to a part of the second signal lines SL2. The demultiplexer 202 is located in the row region RR2 of the display area AA, and is electrically connected to another part of the second signal lines SL2. The connecting lines CL are electrically connected between the corresponding demultiplexers 200 and the corresponding bonding pads BP. For example, the connecting line CL1 is electrically connected between the demultiplexer 201 and the corresponding bonding pad BP, and the connecting line CL2 is electrically connected between the demultiplexer 202 and the other corresponding bonding pad BP.

In the present embodiment, each connecting line CL has at least one first part CLa and at least one second part CLb. The extension direction of the first part CLa is parallel to the extension direction of the first signal lines SL1 (i.e., direction X). And, the extension direction of the second part CLb is parallel to the extension direction of the second signal lines SL2 (i.e., direction Y). In the present embodiment, due to the arrangement relationship of conductive layers, the capacitive coupling effect between the first signal lines SL1 and the connection lines CL is greater than the capacitive coupling effect between the second signal lines SL2 and the connection lines CL. Therefore, at least one second part CLb of the connection lines CL can be selectively overlapped with the second signal lines SL2 in the normal direction of the substrate 101, while the first part CLa of the connection line CL can be selectively not overlapped with the first signal lines SL1 in the normal direction of the substrate 101. Accordingly, on the premise of taking into account the operating electricity, it can also avoid the connection lines CL taking up too much layout space; in other words, the design margin of the overall circuit can be improved. However, the present application is not limited thereto. According to other embodiments, the overlapping relationship between the connection lines CL and the signal lines can be adjusted according to actual design of circuits and configuration of film layers.

On the other hand, the first part CLa of the connecting line CL has a first width W1 in the direction Y, the second part CLb has a second width W2 in the direction X, and the first width W1 is not equal to the second width W2. For example, in the present embodiment, the first width W1 of the first part CLa can be selectively smaller than the second width W2 of the second part CLb. From another point of view, reducing the first width W1 can avoid the first part CLa that cannot overlap the first signal line SL1 taking up too much layout space. Furthermore, increasing the second width W2 of the second part CLb can reduce the resistance of the overall connection line CL which contributes to improve the operating electricity of the pixel array substrate 10. However, the present application is not limited thereto. According to other embodiments, the size relationship between the first width W1 of the first part CLa and the second width W2 of the second part CLb may also be adjusted according to the actual circuit design (e.g., the overlapping relationship between the connecting lines CL and the signal lines).

It should be noted that, in the present embodiment, the number of demultiplexers 200 provided in the same row region of the display area AA is exemplarily described by taking two as examples, and the present application is not limited to the disclosure of the drawings. In other embodiments, the number of demultiplexers 200 provided in the same row region can also be adjusted according to the actual electrical requirements (such as charging efficiency). For example, in an embodiment, the number of demultiplexers 200 is N, and these demultiplexers 200 are respectively arranged in M row regions of display area AA; that is, the number of demultiplexers 200 in any one of the M row regions is about N/M, where M, N and N/M are positive integers. It is noted that by distributing these demultiplexers in different row regions, the design margin of demultiplexer circuits (such as the number of control lines and their configuration corresponding to the demultiplexers) can be increased, which helps to improve operating electricity of the pixel array substrate 10.

For example, a plurality of bonding pads BP of the pixel array substrate 10 can be bonded to a flexible printed circuit (FPC) (not shown), and the flexible printed circuit board includes, for example, a chip on film (COF), or other suitable transmission circuit boards. In other words, the driving signal from the flexible circuit board can be transmitted to the demultiplexers 200 through the connection lines CL. It should be noted that the number of demultiplexers 200, connecting lines CL and bonding pads BP in the present embodiment are for illustrative purposes only, and the present application is limited to the disclosure of the drawings. In other embodiments, the number of demultiplexers 200, connecting lines CL and bonding pads BP can also be adjusted according to the actual circuit design requirements.

In detail, the demultiplexers 200 may have multiple switch circuits and transfer lines TL. The switch circuits, such as the first switch circuit 200*a*, the second switch circuit 200*b*, and the third switch circuit 200*c*, are electrically connected to the corresponding second signal lines SL2, respectively, and the transfer lines TL are electrically connected between the switch circuits. For example, the switch circuit may have an active device (e.g., the active device Tm shown in FIG. 3), and the connection line CL is electrically connected to the corresponding second signal lines SL2 through the active device. In other words, the connection line CL of the present embodiment can be electrically connected to the corresponding three second signal lines SL2 through the demultiplexers 200. It should be noted that, in the present embodiment, the number of the switch circuits of the demultiplexers 200 is exemplarily described by taking three as examples, and the present application is limited to the disclosure of the drawings. According to other embodiments, the number of the switch circuits of the demultiplexers can also be adjusted to two or more than four according to the actual circuit design or electrical requirements.

Referring to FIG. 2 and FIG. 3, the pixel array substrate 10 may further include a buffer layer 110, wherein the connection lines CL are located between the buffer layer 110 and the substrate 101. In the present embodiment, the pixel array substrate 10 may also optionally include multiple light-shielding patterns SM. The light-shielding patterns SM overlap the active devices Td of the pixel circuit PC and the active devices Tm of the switch circuit of the demultiplexer 200 in the normal direction of the substrate 101, to avoid affecting the operating electricity due to the deterioration of the active device under long-term ambient light irradiation. Particularly, in the present embodiment, the connection lines CL (for example, the connection line CL1 and the connection line CL2) and the light-shielding patterns SM can optionally belong to the same film layer (i.e., the first conductive layer 105). However, the present application is not limited thereto. According to other embodiments, the connection lines CL and the light-shielding patterns SM may belong to different film layers. In the present embodiment, the material of the buffer layer 110 includes silicon oxide or silicon nitride.

In the present embodiment, the active devices Td of the pixel circuits PC and the active devices Tm of the switch circuits of the demultiplexers 200 are simultaneously formed during the manufacturing process. In detail, the active device has a gate G, a source S, a drain D and a semiconductor pattern SC. The pixel array substrate 10 further includes a gate insulating layer 120, which is disposed between the gate G and the semiconductor pattern SC. For example, the gate G of the active device can be optionally disposed above the semiconductor pattern SC to form a top-gate TFT, while the present application is not limited thereto. According to other embodiments, the gate G of the active device may also be disposed under the semiconductor pattern SC to form a bottom-gate thin-film transistor (bottom-gate TFT).

Based on the above, the pixel array substrate 10 further includes an interlayer insulating layer 130 covering the gate G of the active device. The source S and the drain D of the active device are disposed on the interlayer insulating layer 130, and respectively overlap two different regions of the semiconductor pattern SC. Specifically, the source S and the drain D penetrate the interlayer insulating layer 130 and the gate insulating layer 120, and are electrically connected to different two regions of the semiconductor pattern SC, respectively. In the present embodiment, the drain D of the active device Tm of the switch circuit (for example, the first switch circuit 200*a*, the second switch circuit 200*b*, or the third switch circuit 200*c*) of the demultiplexer 200 is electrically connected to one corresponding second signal line SL2. And, the second signal line SL2 is electrically connected to the source S of the active device Td of a part of the pixel PX. On the other hand, the transfer line TL of the demultiplexer 200 and the gate G of the active device can be optionally in the same film layer, and the transfer line TL penetrates the gate insulating layer 120 and the buffer layer 110 to electrically connect the connection line CL. In the present embodiment, the active device Tm of the demultiplexer 200 can be, but not limited to, electrically connected to the transfer line TL through the conductive pattern CP.

In the present embodiment, the material of semiconductor pattern SC is, for example, polycrystalline silicon semiconductor; that is, the active device is a polycrystalline silicon TFT. However, the present application is not limited thereto. In other embodiments, the material of semiconductor pattern SC is, for example, amorphous silicon semiconductor or metal oxide semiconductor; that is, the active device may also be amorphous silicon TFT (a-Si TFT) or metal oxide thin film transistor (metal oxide TFT).

Furthermore, the pixel array substrate 10 may further include a planarization layer 140 covering the source S and the drain D of the active device and a part of the surface of the interlayer insulating layer 130, wherein the pixel electrode PE of the pixel PX is disposed on the planarization layer 140 and passed through the planarization layer 140 to electrically connect the drain D of the active device Td of the pixel circuit PC. In the present embodiment, the gate G, the source S, the drain D, the gate insulating layer 120, the interlayer insulating layer 130 and the planarization layer 140 can be adopted from any gate, source, drain, gate insulating layer, interlayer insulating layer and planarization layer of pixel array substrates which are well known by those of ordinary skill in the art. And, the gate G, the source S, the drain D, the gate insulating layer 120, the interlayer insulating layer 130 and the planarization layer 140 can be formed by any method well known to those of ordinary skill in the art, and is not repeated herein.

In the present embodiment, since the first conductive layer 105 (including the connecting lines CL and the light-shielding patterns SM) is located between the semiconductor patterns SC and the substrate 101, the connecting lines CL (e.g., the connecting line CL1 and the connection line CL2) can be made of molybdenum or molybdenum oxide, in order to increase the process tolerance of the semiconductor pattern SC. More specifically, the electrical resistivity of the connecting line CL (e.g., the connecting line CL1 and the connecting line CL2) is greater than the electrical resistivity of the first signal lines SL1 and the second signal lines SL2. It is noted that, by disposing the demultiplexers 200 and the connecting lines CL in the display area AA, the area of the peripheral area PA can be effectively reduced, which helps to realize the narrow border design of the display panel. In addition, the layout space of the circuit can be increased by arranging the connecting lines CL in the first conductive layer 105, which helps to improve the circuit design margin of the pixel array substrate.

In particular, the pixel electrodes PE of the pixel array substrate 10 may also be provided with light emitting diode devices (not shown) thereon to form a light emitting diode display panel, where the light emitting diode devices is, for example, an organic light emitting diode (OLED), a micro light emitting diode (micro LED) or a mini light emitting diode (mini LED). However, the present application is not limited thereto. According to other embodiments, the pixel array substrate 10 may also be provided with a display medium layer and a counter substrate thereon, wherein the display medium layer is located between the pixel array substrate 10 and the counter substrate, and the counter substrate has common electrodes. The display medium layer here includes, for example, liquid crystal molecules, and the electric field formed between the pixel electrodes PE and the common electrodes is suitable for driving the liquid crystal molecules to rotate and be arranged corresponding to the distribution of the electric field. That is, in other embodiments not shown, the display panel adopting the pixel array substrate 10 may be a liquid crystal display panel.

The following will propose some other embodiments to explain the disclosure in detail, in which the same components are marked with the same reference numbers or characters. The description of the same technical content is not repeated below and can be refer to the foregoing embodiments.

Figure 4:
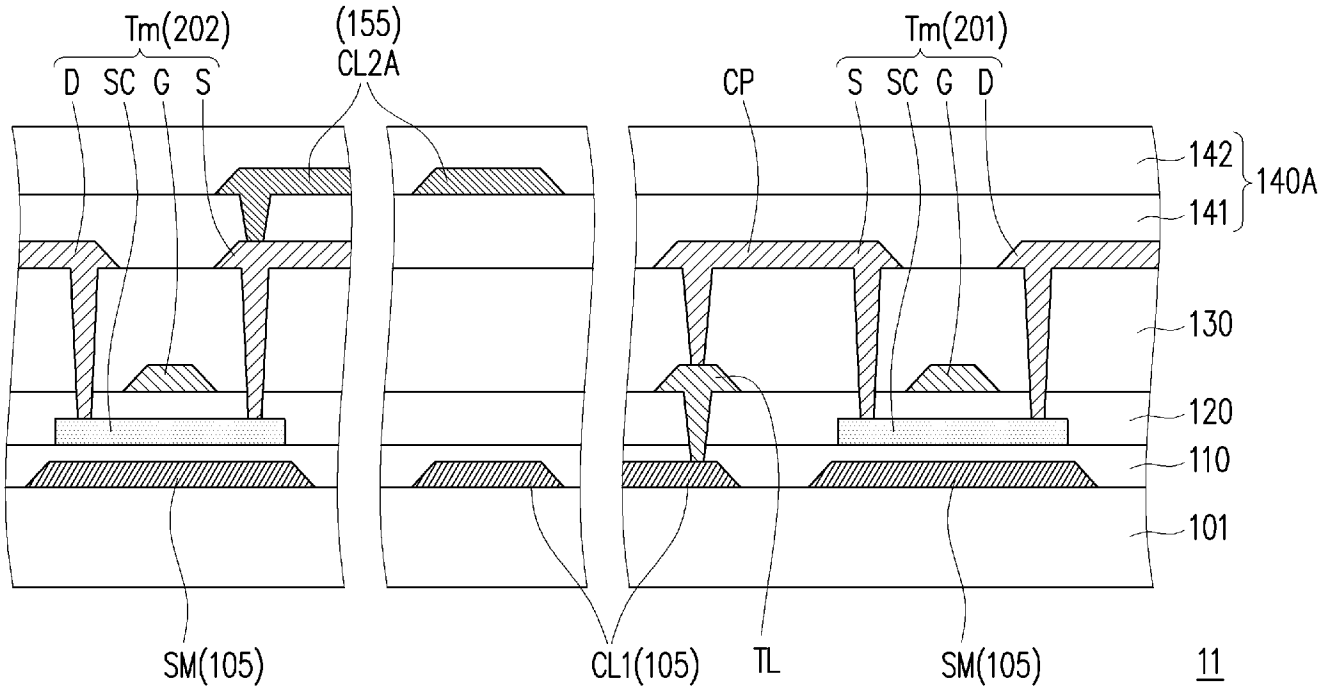
FIG. 4 is a cross-sectional view of a pixel array substrate according to a second embodiment of the present application.

FIG. 4 is a cross-sectional view of a pixel array substrate of a second embodiment of the present application. Referring to FIG. 4, the main difference between the pixel array substrate 11 of the present embodiment and the pixel array substrate 10 of FIG. 3 lies in the arrangement of the connecting lines. In the present embodiment, the connection line CL1 and the connection line CL2A are belong to different film layers; for example, the connection line CL1 is formed in the first conductive layer 105, and the connection line CL2A is formed in the second conductive layer 155, and the first conductive layer 105 is located between the second conductive layer 155 and the substrate 101.

In detail, the planarization layer 140A of the present embodiment may be a stacked structure of the first planarization sublayer 141 and the second planarization sublayer 142, and the second conductive layer 155 is located between the first planarization sublayer 141 and the second planarization sublayer 142. The connection line CL1 is electrically connected to the source S of the active device Tm of the demultiplexer 201 through the transfer line TL and the conductive pattern CP. The connection line CL2A penetrates the first planarization sublayer 141 to electrically connect the source S of the active device Tm of the demultiplexer 202. In the present embodiment, the connection line CL1 may overlap the connection line CL2A in the normal direction of the substrate 101. Accordingly, the layout space required by multiple connecting lines can be reduced.

Figure 5:
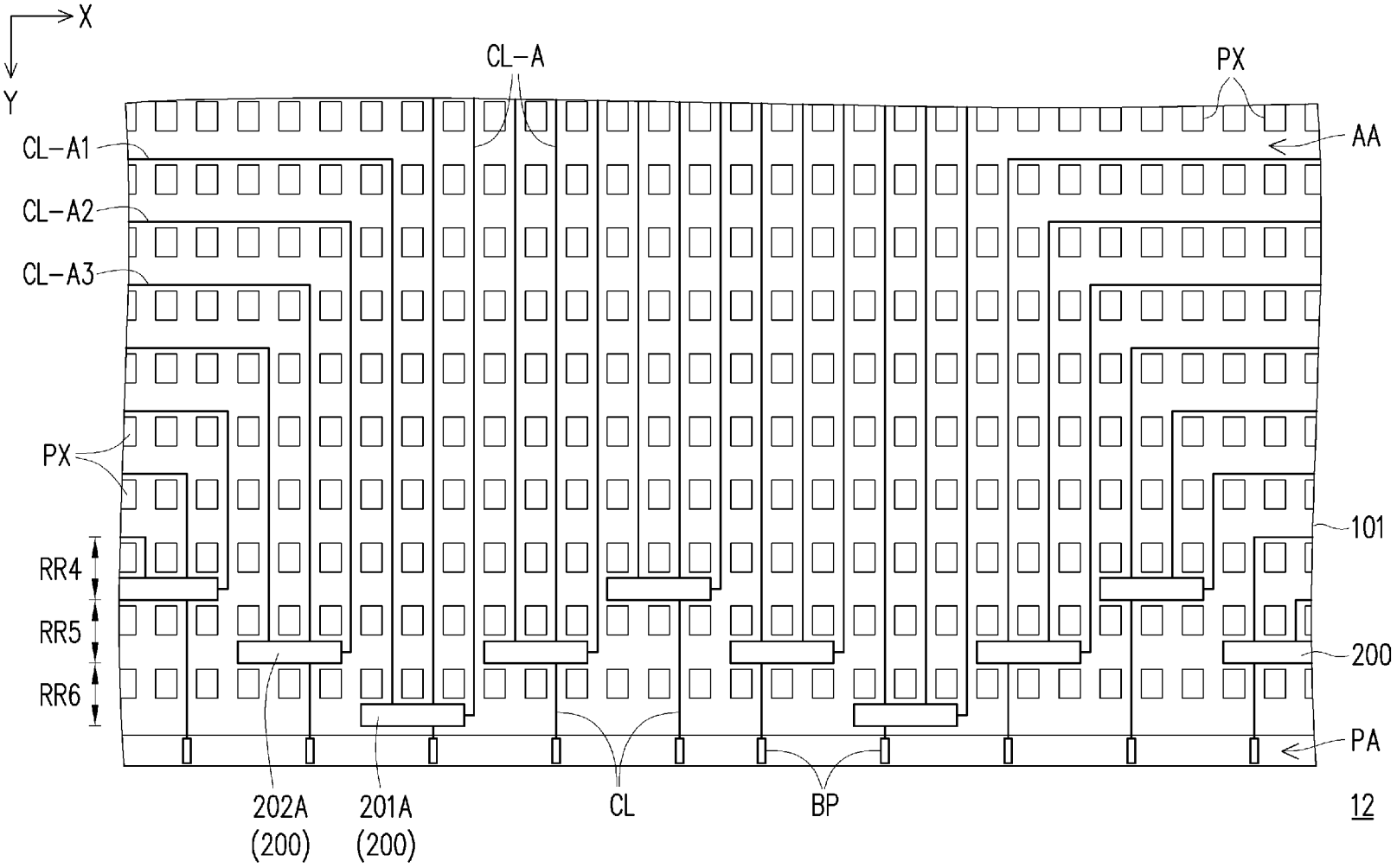
FIG. 5 is a schematic top view of a pixel array substrate according to a third embodiment of the present application.
Figure 6:
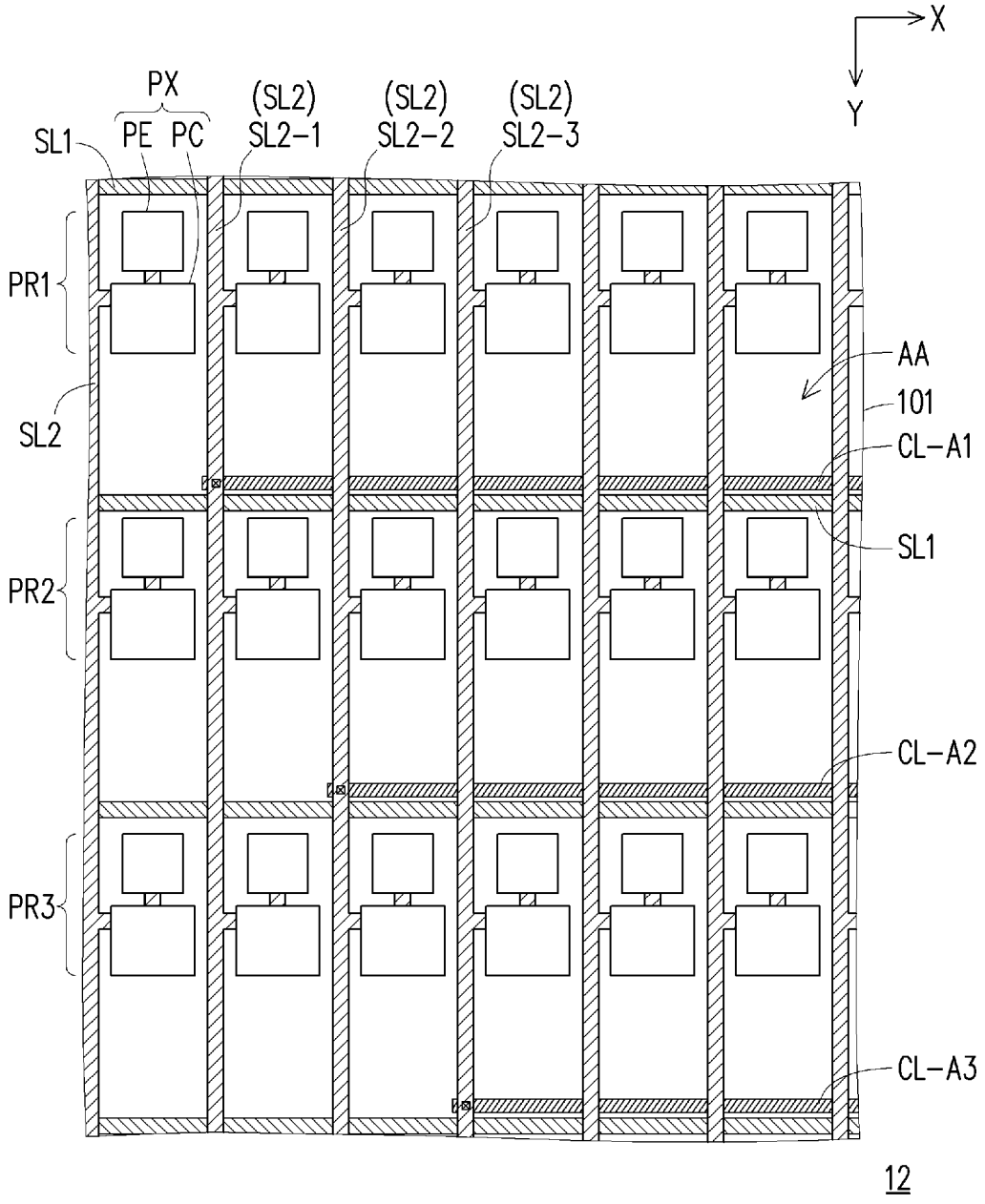
FIG. 6 is an enlarged schematic view of a partial area of the pixel array substrate of FIG. 5.

FIG. 5 is a schematic top view of a pixel array substrate according to a third embodiment of the present application. FIG. 6 is an enlarged schematic view of a partial area of the pixel array substrate of FIG. 5. For the sake of clarity, FIG. 5 does not show the first signal line SL1 and second signal line SL2 of FIG. 6. Referring to FIG. 5 and FIG. 6, the main difference between the pixel array substrate 12 of the present embodiment and the pixel array substrate 10 of FIG. 1 lies in the arrangement of the demultiplexers and the connection lines in the display area AA. In the present embodiment, multiple demultiplexers 200 are respectively disposed in the row region RR4, the row region RR5 and the row region RR6 adjacent to the peripheral area PA, and any two adjacent demultiplexers 200 are shifted from each other in the direction X. It is noted that by distributing these demultiplexers 200 in different row regions, the design margin of demultiplexer circuit (such as the number of control lines corresponding to the demultiplexer) can be increased, which helps to improve the operating electricity of the pixel array substrate 10.

On the other hand, the pixel array substrate 12 further includes a plurality of connecting lines CL-A. For example, the connection line CL-A1 is electrically connected between the demultiplexer 201A and the second signal line SL2-1, the connection line CL-A2 is electrically connected between the demultiplexer 202A and the second signal line SL2-2, the connection line CL-A3 is electrically connected between demultiplexer 202A and second signal line SL2-3. It should be noted that, in the present embodiment, the number of the connecting lines CL-A (or second signal line SL2) electrically connected to the same demultiplexer 200 is exemplarily described by taking three as examples, and the present application is not limited thereto. In other embodiments, the number of connecting lines CL-A electrically connected to the same demultiplexer 200 can be adjusted to two or more than four according to the actual circuit design or electrical requirements.

In the present embodiment, the material of the connecting lines CL-A electrically connected between the demultiplexers 200 and the second signal lines SL2 and the connecting lines CL electrically connected between the demultiplexers 200 and the bonding pads BP are the same; that is, the connection lines CL-A and the connection lines CL may belong to the same film layer (for example, the first conductive layer 105 shown in FIG. 3). However, the present application is not limited thereto. According to other embodiments, the connection lines CL-A and the connection lines CL may belong to different film layers (for example, the first conductive layer 105 and the second conductive layer 155 shown in FIG. 4). In particular, the layout flexibility of the demultiplexers 200 in the display area AA can be increased through the configuration of the connection lines CL-A.

In summary, according the pixel array substrate of an embodiment of the present application, the peripheral area can be effectively reduced by the configuration relationship between the demultiplexers located in the display area and the connecting lines, which helps to realize the narrow border design of the display panel. In addition, the circuit design margin of the pixel array substrate can be increased because the electrical resistivity of the connecting lines is greater than the electrical resistivity of the signal lines. On the other hand, by disposing two demultiplexers in different row regions of the pixel area, the design margin of the demultiplexer can be increased, and the operating electricity of the pixel array substrate can be thereby improved.

It will be apparent to those skilled in the art that various modifications and variations can be made to the disclosed embodiments without departing from the scope or spirit of the disclosure. In view of the foregoing, it is intended that the disclosure covers modifications and variations within the scope of the following claims and their equivalents.

What is claimed is:

1. A pixel array substrate, comprising:

a substrate having a display area;

a plurality of first signal lines, arranged on the substrate and defining a first row region and a second row region of the display area;

a plurality of second signal lines, intersected with the first signal lines;

a plurality of pixels, electrically connected to the corresponding first signal lines and the corresponding second signal lines respectively, wherein the pixels are arranged into a first pixel row and a second pixel row, and the first pixel row and the second pixel row are respectively disposed in the first row region and the second row region;

a first demultiplexer, disposed in the first row region and electrically connected to a part of the second signal lines;

a second demultiplexer, disposed in the second row region and electrically connected to another part of the second signal lines;

a first connecting line, electrically connected to the first demultiplexer; and a second connecting line, electrically connected to the second demultiplexer, wherein an electrical resistivity of the first connecting line and the second connecting line is greater than an electrical resistivity of the first signal lines and the second signal lines.

2. The pixel array substrate as claimed in claim 1, further comprising a plurality of bonding pads disposed on a peripheral area of the substrate, and the peripheral area being located on one side of the display area, wherein the first connecting line is electrically connected between one of the bonding pads and the first demultiplexer, and the second connecting line is electrically connected between another one of the bonding pads and the second demultiplexer.

3. The pixel array substrate as claimed in claim 1, wherein the first demultiplexer is electrically connected to one of the second signal lines through the first connecting line, and the second demultiplexer is connected to another one of the second signal lines through the second connecting line.

4. The pixel array substrate as claimed in claim 1, wherein the pixels each have a semiconductor pattern, the first connecting line and the second connecting line are in a first conductive layer, and the first conductive layer is located between the semiconductor pattern and the substrate.

5. The pixel array substrate as claimed in claim 1, wherein the first connecting line and the second connecting line are respectively in a first conductive layer and in a second conductive layer, and the first conductive layer is located between the substrate and the second conductive layer.

6. The pixel array substrate as claimed in claim 5, wherein the first connecting line overlaps the second connecting line.

7. The pixel array substrate as claimed in claim 1, wherein the first connecting line and the second connecting line respectively have at least one first part and at least one second part, and an extension direction of the first part is parallel to an extension direction of the first signal lines, and an extension direction of the second part is parallel to an extension direction of the second signal lines.

8. The pixel array substrate as claimed in claim 7, wherein the at least one second part overlaps at least one of the second signal lines in a normal direction of the substrate.

9. The pixel array substrate as claimed in claim 7, wherein the at least one first part has a first width in an extension direction perpendicular to the first signal lines, and the at least one second part has a second width in an extension direction perpendicular to the second signal lines, and the first width is not equal to the second width.

10. The pixel array substrate as claimed in claim 9, wherein the first width of the at least one first part is smaller than the second width of the at least one second part.

11. The pixel array substrate as claimed in claim 1, wherein at least one of the first connecting line and the second connecting line overlaps the second signal lines.

12. A pixel array substrate, comprising:

a substrate having a display area;

a plurality of first signal lines, arranged on the substrate and defining a first row region and a second row region of the display area;

a plurality of second signal lines, intersected with the first signal lines;

a plurality of pixels, electrically connected to the corresponding first signal lines and the corresponding second signal lines respectively, wherein the pixels are arranged into a first pixel row and a second pixel row, and the first pixel row and the second pixel row are respectively disposed in the first row region and the second row region;

a first demultiplexer, disposed in the first row region and electrically connected to a part of the second signal lines;

a second demultiplexer, disposed in the second row region and electrically connected to another part of the second signal lines; and a first connecting line and a second connecting line, electrically connected to the first demultiplexer and the second demultiplexer respectively, wherein an electrical resistivity of the first connecting line and the second connecting line is greater than an electrical resistivity of the first signal lines and the second signal lines, the first connecting line and the second connecting line respectively have at least one first part and at least one second part, wherein the first part has a first width in an extension direction perpendicular to the first signal lines, the second part has a second width in an extension direction perpendicular to the second signal lines, and the first width is not equal to the second width.

13. The pixel array substrate as claimed in claim 12, wherein the first width of the at least one first part is smaller than the second width of the at least one second part.

14. The pixel array substrate as claimed in claim 12, further comprising a plurality of bonding pads disposed on a peripheral area of the substrate, and the peripheral area is located on one side of the display area, wherein the first connecting line is electrically connected between one of the bonding pads and the first demultiplexer, and the second connecting line is electrically connected between another one of the bonding pads and the second demultiplexer.

15. The pixel array substrate as claimed in claim 12, wherein the first demultiplexer is electrically connected to a part of the second signal lines through the first connecting line, and the second demultiplexer is electrically connected to another part of the second signal lines through the second connecting line.

16. The pixel array substrate as claimed in claim 12, wherein the pixels each have a semiconductor pattern, the first connecting line and the second connecting line are in a first conductive layer, and the first conductive layer is located between the semiconductor pattern and the substrate.

17. The pixel array substrate as claimed in claim 12, wherein the first connecting line and the second connecting line are respectively in a first conductive layer and a second conductive layer, and the first conductive layer is located between the substrate and the second conductive layer.

18. The pixel array substrate as claimed in claim 12, wherein an extension direction of the first part is parallel to an extension direction of the first signal lines, and an extension direction of the second part is parallel to an extension direction of the second signal lines.

19. The pixel array substrate as claimed in claim 12, wherein the at least one second part overlaps at least one of the second signal lines.

20. The pixel array substrate as claimed in claim 12, wherein the at least one first part does not overlap the first signal lines.

* * * * *